US008505471B2

(12) United States Patent
Mogi

(10) Patent No.: US 8,505,471 B2
(45) Date of Patent: Aug. 13, 2013

(54) BURNING EQUIPMENT

(75) Inventor: Kunitoyo Mogi, Nagano (JP)

(73) Assignee: Moki Seisakusho Co., Ltd., Nagano (JP)

( * ) Notice: Subject to any disclaimer, the term of this patent is extended or adjusted under 35 U.S.C. 154(b) by 70 days.

(21) Appl. No.: 13/206,165

(22) Filed: Aug. 9, 2011

(65) Prior Publication Data

US 2012/0037055 A1 Feb. 16, 2012

(51) Int. Cl.
*F23N 3/00* (2006.01)

(52) U.S. Cl.
USPC ..... 110/297; 110/322; 110/184; 110/211; 110/326

(58) Field of Classification Search
USPC ..... 110/267, 292, 211, 322, 326, 331
See application file for complete search history.

(56) References Cited

U.S. PATENT DOCUMENTS

| | | | | | |
|---|---|---|---|---|---|
| 86,620 | A | * | 2/1869 | Woodson | 126/73 |
| 839,797 | A | * | 12/1906 | Wood | 422/180 |
| 2,392,587 | A | * | 1/1946 | Goerg | 110/322 |
| 3,043,246 | A | * | 7/1962 | Hebert | 110/211 |
| 3,079,878 | A | * | 3/1963 | Vargo, Jr. et al. | 110/211 |
| 3,792,671 | A | * | 2/1974 | Woods | 110/346 |
| 4,440,145 | A | * | 4/1984 | Neyenhouse | 126/61 |
| 4,718,357 | A | * | 1/1988 | Wang et al. | 110/235 |
| 5,170,724 | A | * | 12/1992 | Mogi | 110/235 |
| 5,285,738 | A | * | 2/1994 | Cullen | 110/233 |
| 5,579,704 | A | * | 12/1996 | Mansur | 110/185 |
| 2009/0255449 | A1 | * | 10/2009 | Mogi | 110/208 |

FOREIGN PATENT DOCUMENTS

| | | | |
|---|---|---|---|
| JP | U49-39269 | A | 7/1972 |
| JP | P49-126185 | A1 | 12/1974 |
| JP | 4121512 | A | 4/1992 |
| JP | 3066066 | B2 | 7/2000 |
| JP | 2009250579 | A | 10/2009 |

* cited by examiner

*Primary Examiner* — Kenneth Rinehart
*Assistant Examiner* — Sharla Magana
(74) *Attorney, Agent, or Firm* — Muncy, Geissler, Olds & Lowe, PLLC

(57) ABSTRACT

A burning equipment for improving burning efficiency with a simple structure. The burning equipment includes a burning chamber having a top plate section and a bottom plate section; a first burn-promoting plate extending downward from the top plate section until the lower end reaches a prescribed height from the bottom plate section, dividing the burning chamber into a primary burning chamber and a secondary burning chamber, and having a plurality of through-holes; and an air outlet being provided to the secondary burning chamber. The air outlet is provided to the top plate section. A second burn-promoting plate extends downward from the top plate section, in the secondary burning chamber, until the lower end reaches a prescribed height from the bottom plate section. It divides an opening of the air outlet and also has a plurality of through-holes.

6 Claims, 5 Drawing Sheets

BURNING EQUIPMENT

CROSS-REFERENCE TO RELATED APPLICATION

This application is based upon and claims the benefit of priority of the prior Japanese Patent Application No. P2010-179211, filed on Aug. 10, 2010, and the entire contents of which are incorporated herein by reference.

BACKGROUND OF THE INVENTION

The present invention relates to a burning equipment comprising: a burning chamber having a top plate section and a bottom plate section; a burn-promoting plate being extended downward from the top plate section until the lower end reaches a prescribed height from the bottom plate section, the first burn-promoting plate dividing the burning chamber into a primary burning chamber and a secondary burning chamber, the first burn-promoting plate having through-holes; a burnable material inlet and an air inlet being provided to the primary chamber; and an air outlet being provided to the secondary burning chamber.

The inventor of the present invention has obtained Japanese patent rights of burning equipments for burning many kinds of solid burnable materials, e.g., fire wood. The burning equipments are capable of reducing smoke, increasing temperature and improving burning performance.

One of the burning equipments comprises: a burning chamber being formed by a top plate section, a bottom plate section and side plates; a material/air inlet for introducing burnable materials and air into the burning chamber, the material/air inlet being formed in a half part of the top plate section; an inlet lid for opening and closing the material/air inlet; an air outlet being formed in the other half part of the top plate section or one of the side plates; and a burn-promoting plate being provided between the material/air inlet and the air outlet and extended downward until the lower end reaches a prescribed position so as to form a space, whose height is ¼ to ⅓ of a height of the burning chamber, between the lower end and the bottom plate section. With this structure, the burn-promoting plate divides the burning chamber into a primary burning chamber, which communicates with the material/air inlet, and a secondary burning chamber, which communicates with the air outlet. Many through-holes, which make the primary burning chamber communicate with the secondary burning chamber, are dispersedly formed in the burn-promoting plate (see claim 1 and FIG. 1 of JP Pat. No. 3,066,066).

Another other one is a smokeless burning equipment comprising: a burning chamber; a material/air inlet for supplying a burnable material and air into the burning chamber, the material/air inlet being located close to one end of an upper wall of the burning chamber; an inlet lid for opening and closing the material/air inlet; an exhaust air outlet for discharging air, the exhaust air outlet being located close to the other end of the upper wall of the burning chamber; a burn-promoting plate dividing the burning chamber into a primary burning chamber and a secondary burning chamber, the burn-promoting plate being provided between the material/air inlet and the exhaust air outlet, located closely to the exhaust air outlet and extended downward from the inner face of the upper ceiling wall of the burning chamber; a communication path for communicating the primary burning chamber to the secondary burning chamber, the communication path being formed between the lower end of the burn-promoting plate and an inner face of a bottom wall of the burning chamber; a plurality of through-holes for communicating the primary burning chamber to the secondary burning chamber, the through-holes being dispersedly formed in the burn-promoting plate; a dry wood inlet being provided to a wall of the secondary burning chamber and located under the exhaust air outlet; and a guide tube for guiding a dry wood, the guide tube being attached to the dry wood inlet. In use, firstly, dry wood is introduced into the primary burning chamber to perform preliminary burning, and then a temperature of the burning chamber is increased and maintained at a prescribed high temperature. Further, a large amount of embers are produced and extended on the entire bottom plate section of the burning chamber (see claim 1 and FIG. 1 of JP Pat. No. 4,465,013).

In the above described conventional burning equipments, by effectively heating the burn-promoting plate, burning can be stabilized, in a short time, from ignition and performed at a high temperature, so that smoke can be reduced. Therefore, solid burnable materials can be effectively burnt.

However, to further improve burning performance of the burning equipment, a blower, for example, may be provided to compulsorily supply air, but in this case an electric power source must be required, the structure of the burning equipment must be complex, and a production cost thereof must be increased.

Namely, it is difficult for the conventional burning equipments to improve burning performance without complicating the structure and increasing the production cost.

SUMMARY OF THE INVENTION

The present invention was conceived to solve the above described problem.

Accordingly, it is objects to provide a burning equipment so as to solve the above described problem of the conventional technology.

Namely, the burning equipment of the present invention is capable of improving burning efficiency with a simple structure.

To achieve the objects, the present invention has following structures.

Namely, the burning equipment of the present invention comprises:

a burning chamber having a top plate section and a bottom plate section;

a first burn-promoting plate being extended downward from an inner face of the top plate section until the lower end reaches a prescribed height from an inner face of the bottom plate section, the first burn-promoting plate dividing the burning chamber into a primary burning chamber and a secondary burning chamber, the first burn-promoting plate having a plurality of through-holes;

a burnable material inlet and an air inlet being provided to the primary chamber; and an air outlet being provided to the secondary burning chamber, the air outlet is provided to a part of the top plate section in the secondary burning chamber, and at least one second burn-promoting plate is extended downward from the inner face of the top plate section, in the secondary burning chamber, until the lower end reaches a prescribed height from the inner face of the bottom plate section, the second burn-promoting plate crosses and divides an opening of the air outlet, the second burn-promoting plate has a plurality of through-holes as well as the first burn-promoting plate.

Preferably, a distance between the lower end of each of the burn-promoting plates and the inner face of the bottom plate section is ¼ to ⅓ of a height of the burning chamber.

Preferably, the burning chamber, which is divided into the primary burning chamber and the secondary burning chamber, is formed by a tubular wall plate formed into a tubular shape, a front end plate and a rear end plate, and the burn-promoting plates and an inner face of the rear end plate on the secondary burning chamber side are arranged parallel and equally spaced.

Preferably, the burning chamber, which is divided into the primary burning chamber and the secondary burning chamber, is formed by a tubular wall plate formed into a tubular shape, a front end plate and a rear end plate, and the burnable material inlet is provided to the front end plate on the primary burning chamber side.

Further, preferably, a dry wood inlet is provided to a part of the tubular wall plate in the secondary burning chamber, which is located under the air outlet, and a guide tube is provided to the dry wood inlet so as to guide dry wood to be burnt.

In the burning equipment of the present invention, burning performance can be improved in spite of the simple structure.

BRIEF DESCRIPTION OF THE DRAWINGS

Embodiments of the present invention will now be described by way of examples and with reference to the accompanying drawings, in which.

DETAILED DESCRIPTION OF THE EMBODIMENTS

Preferred embodiments of the present invention will now be described in detail with reference to the accompanying drawings.

Figure 1:
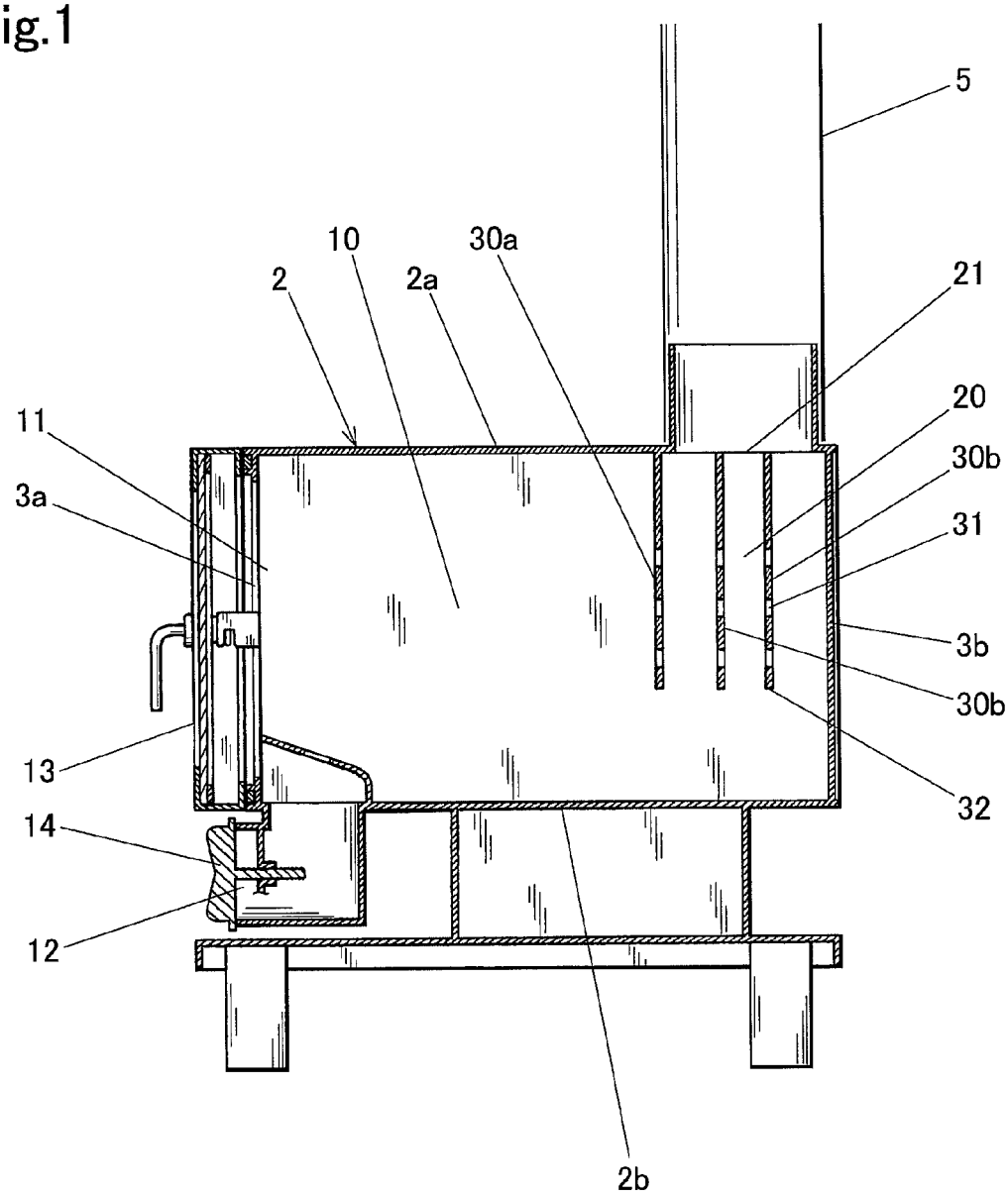
FIG. 1 is a sectional view of a first embodiment of the burning equipment of the present invention.
Figure 2:
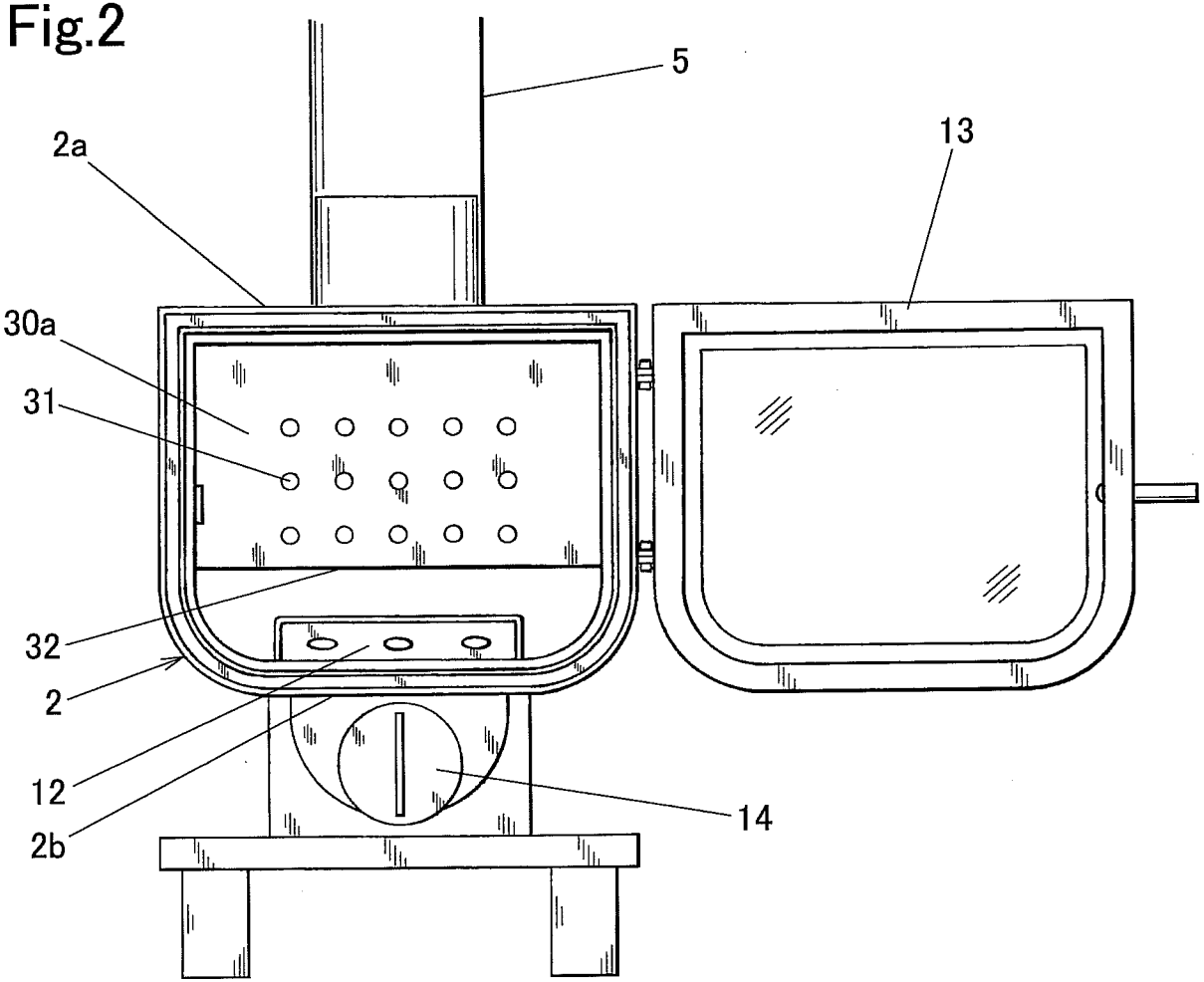
FIG. 2 is a front view of the burning equipment shown in FIG. 1, wherein a door member is opened.
Figure 3:
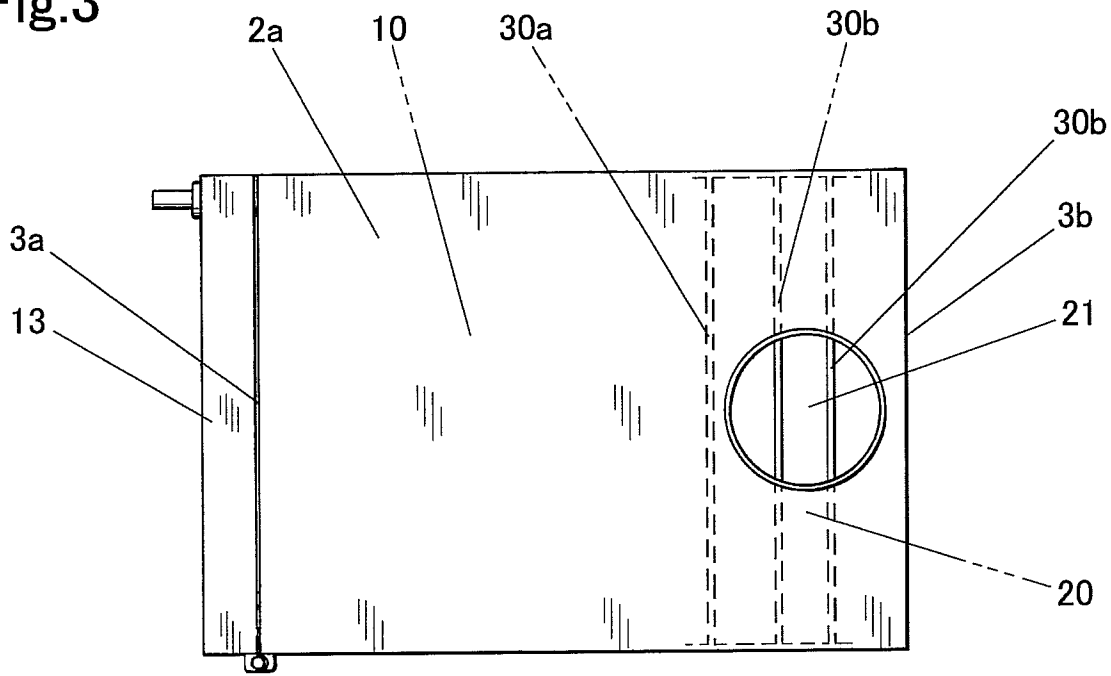
FIG. 3 is a plan view of the burning equipment shown in FIG. 1, wherein the door member is closed.

Firstly, a first embodiment of the burning equipment will be explained with reference to FIGS. 1-3.

In the burning equipment, a burning chamber is divided into a primary burning chamber 10, which has a burnable material inlet 11 and an air inlet 12, and a secondary burning chamber 20, which has an air outlet 21, by a first burn-promoting plate 30*a*. The first burn-promoting plate 30*a* is extended downward from an inner face of a top plate section 2*a* until the lower end 32 reaches a prescribed height from an inner face of a bottom plate section 2*b*. The first burn-promoting plate 30*a* has many through-holes 31. The primary chamber 10 and the secondary chamber 20 are horizontally aligned, so the burning equipment is a transverse-installed type burning equipment.

The air outlet 21 is provided to a part of the top plate section 2*a* in the secondary burning chamber 20. At least one second burn-promoting plate 30*b*, which is equivalent to the first burn-promoting plate 30*a*, is provided in the secondary burning chamber 20. Each of the second burn-promoting plates 30*b* crosses and divides an opening of the air outlet 21. Each of the second burn-promoting plates 30*b* is also fixed to the top plate section 2*a* as well as the first burn-promoting plate 30*a*.

In the first embodiment, two second burn-promoting plates 30*b* are provided to cross the opening of the air outlet 21, so three burn-promoting plates 30*a* and 30*b* are provided in the burning chamber. The number of the second burn-promoting plates 30*b* is not limited to two as in the present embodiment, but it may be selected according to the size of the air outlet 21. The burn-promoting plates 30*a* and 30*b* of the present embodiment are, for example, basically flat plates and composed of a metal which can be red-heated.

The air outlet 21 is located at a transverse center of the secondary burning chamber 20, and a smokestack 5, which is connected to the air outlet 21, is vertically extended upward from the top plate section 2*a*.

In the present embodiment, an anterior-posterior width of the secondary burning chamber 20 is slightly greater than a diameter of the smokestack 5, and a capacity of the secondary burning chamber 20 is smaller than that of the first burning chamber 10.

In the burning equipment having a plurality of the burn-promoting plates 30*a* and 30*b*, the secondary burning chamber 20 can be effectively heated by a suitable convection effect of heated air, and the heated air can be smoothly discharged by a uniform rectifying flow effect. Therefore, the burning performance of the burning equipment can be improved.

In comparison with the conventional burning equipment having one burn-promoting plate, an amount of dusts discharged, from the smokestack 5, per hour can be reduced, a surface temperature of the smokestack 5 can be lowered, and a surface temperature of the top plate section 2*a* can be increased. Therefore, the burning performance of the burning equipment of the present embodiment can be highly improved as the ideal burning equipment.

In the present embodiment, a distance between the lower end 32 of each of the burn-promoting plates 30*a* and 30*b* and the inner face of the bottom plate section 2*b* is designed to suitably flow the heated air. For example, the distance is ¼ to ⅓ of a height of the burning chamber.

Preferably, a total area of the through-holes 31 in each of the burn-promoting plates is 15-25% of an area of each of the burn-promoting plates 30*a* and 30*b*. By forming many through-holes 31 in the burn-promoting plates 30*a* and 30*b*, the flow of the heated air from the primary burning chamber 10 to the secondary burning chamber 20 can be automatically balanced when the balance of the flow is lost. Therefore, stable burning can be realized.

In the present embodiment, the burning chamber, which is divided into the primary chamber 10 and the secondary chamber 20, is defined by a tubular wall plate 2, a front end plate 3*a* and a rear end plate 3*b*. The burn-promoting plates 30*a* and 30*b* and an inner face of the rear end plate 3*b* on the secondary burning chamber side are arranged parallel and equally spaced. With this structure, the burn-promoting plates 30*a* and 30*b* can be effectively heated with balance, and the heated air can be discharged with balance. Therefore, the air flow can be rectified, and the burning performance of the burning equipment can be highly improved.

In the present embodiment, as described above, the burning chamber, which is divided into the primary chamber 10 and the secondary chamber 20, is defined by the tubular wall plate 2 and the end plate 3*a* and 3*b*, and the burnable material inlet 11 is provided to the front end plate 3*a*, which is located on the primary burning chamber side. With this structure, leakage of the heated air can be restrained, and burnable materials can be easily put into a suitable place of the burning chamber.

Figure 5:
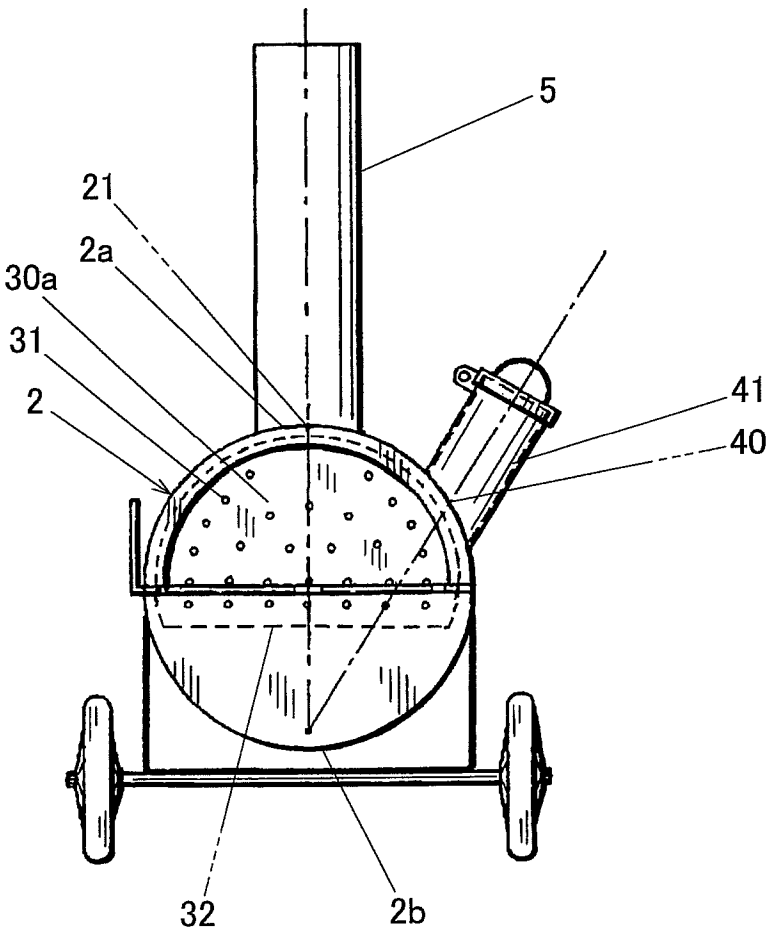
FIG. 5 is a front view of the burning equipment shown in FIG. 4, wherein the door member is opened.

Note that, the tubular wall plate 2 may be formed into, for example, a rectangular tube shape (see FIG. 2) or a circular tube shape (see FIG. 5). The rectangular tube shape wall plate 2 is constituted by the top plate section 2*a*, the bottom plate section 2*b* and the side plate sections. Further, in the present embodiment, a door member 13 opens and closes the burnable material inlet 11 and includes a smoked semi-transparent window. A lid 14 opens and closes the air inlet 12.

Figure 4:
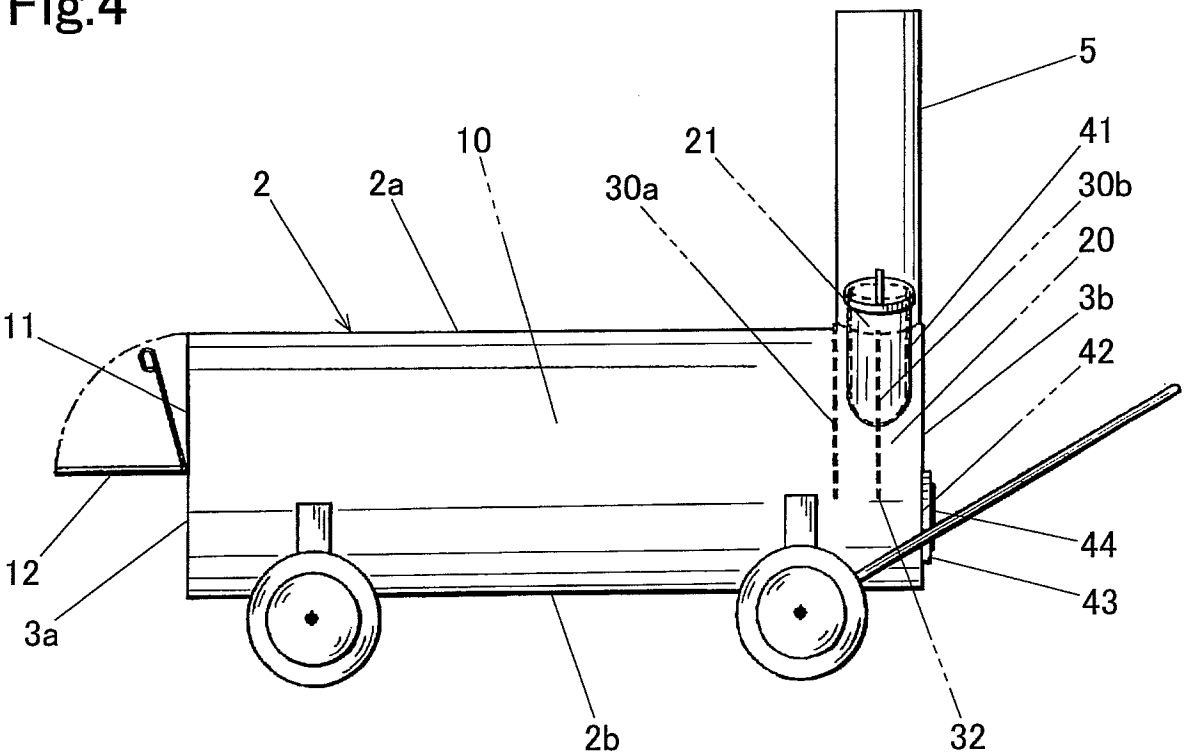
FIG. 4 is a side view of a second embodiment of the burning equipment.

A second embodiment of the burning equipment of the present invention will be explained with reference to FIGS. 4 and 5. Note that, the structural elements described in the first embodiment are assigned the same numeric symbols and explanation will be omitted.

In the second embodiment, a dry wood inlet 40 is provided to a part of the tubular wall plate 2 in the secondary burning chamber 20, which is located under the air outlet 21, and a guide tube 41 is provided to the dry wood inlet 40 so as to guide a dry wood to be burnt.

With this structure, the burn-promoting plates 30*a* and 30*b* have been heated by preliminary burning, so that the secondary burning chamber 20 has been maintained at a high temperature. Therefore, the dry wood put in the secondary burning chamber 20 is rapidly burnt from the lower end thereof. At that time, a high power of sucking air toward the smokestack 5 can be maintained. In the secondary burning chamber 20, the dry wood is burnt from the lower end and naturally falls along the guide tube 41, so that the lower end of the long dry wood can continuously stay at the same place. Therefore, the temperature of the secondary burning chamber 20 can be easily suitably maintained at the much high temperature. By maintaining the secondary burning chamber 20 at the high temperature, smokeless burning can be performed without leaving embers, and producing ash can be highly restrained.

An air damper 44 is provided to a lower part of the secondary burning chamber 20 (e.g., a lower part of the rear end plate 3*b*). By actuating the air damper 44, a necessary amount of air can be easily supplied to the second burning chamber 20, so that the smokeless burning can be performed.

The air outlet 21 is provided to the top part of the tubular wall plate 2 which corresponds to the second burning chamber 20 (the top of the rear end part of the tubular wall plate 2), and the smokestack 5 is upwardly extended from the air outlet 21. An axial line of the guide tube 41 is inclined with respect to that of the smokestack 5 so as to cross or nearly cross the axial lines at or near a center of an inner face of the bottom plate section of the secondary burning chamber 20. By inclining the center line of the guide tube 41 with respect to that of the smokestack 5, even if the lower end of the dry wood is burnt, the dry wood naturally falls along the guide tube 41 and the lower end of the dry wood can stay at the center of the bottom plate section, to which the axial line of the smokestack 5 corresponds. Therefore, the lower end of the dry wood can be continuously burnt at the same place by the natural fall, so that the temperature of the secondary burning chamber 20 can be easily maintained at desired high temperature.

An ash outlet 42 is provided to a lower part of the secondary burning chamber 20, and a lid 43, to which the air damper 44 is attached, opens and closes the ash outlet 42. The lid 43 is opened when surplus ash stored in the first burning chamber 10 and/or the secondary burning chamber 20 is discharged through the ash outlet 42, or when the ash left in the primary chamber 10 and the secondary chamber 20 is flattened, with a uniform thickness, for the next burning operation.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention has been described in detail, it should be understood that the various changes, substitutions, and alternations could be made hereto without departing from the spirit and scope of the invention.

What is claimed is:

1. A burning equipment, comprising:

a burning chamber having a top plate section and a bottom plate section;

a first burn-promoting plate being extended downward from an inner face of the top plate section until the lower end reaches a prescribed height from an inner face of the bottom plate section, the first burn-promoting plate dividing the burning chamber into a primary burning chamber and a secondary burning chamber, the first burn-promoting plate having a plurality of through-holes;

a burnable material inlet and an air inlet being provided to the primary chamber; and an air outlet being provided to the secondary burning chamber, wherein the air outlet is provided to a part of the top plate section in the secondary burning chamber, and a second burn-promoting plate is extended downward from the inner face of the top plate section, in the secondary burning chamber, until the lower end reaches a prescribed height from the inner face of the bottom plate section, the second burn-promoting plate crosses and divides an opening of the air outlet, the second burn-promoting plate has a plurality of through-holes as well as the first burn-promoting plate.

2. The burning equipment according to claim 1, wherein a distance between the lower end of each of the burn-promoting plates and the inner face of the bottom plate section is ¼ to ⅓ of a height of the burning chamber.

3. The burning equipment according to claim 1, wherein the burning chamber, which is divided into the primary burning chamber and the secondary burning chamber, is formed by a tubular wall plate formed into a tubular shape, a front end plate and a rear end plate, and the burn-promoting plates and an inner face of the rear end plate on the secondary burning chamber side are arranged parallel and equally spaced.

4. The burning equipment according to claim 1, wherein the burning chamber, which is divided into the primary burning chamber and the secondary burning chamber, is formed by a tubular wall plate formed into a tubular shape, a front end plate and a rear end plate, and the burnable material inlet is provided to the front end plate on the primary burning chamber side.

5. The burning equipment according to claim 3, wherein a dry wood inlet is provided to a part of the tubular wall plate in the secondary burning chamber, which is located under the air outlet, and a guide tube is provided to the dry wood inlet so as to guide dry wood to be burnt.

6. The burning equipment according to claim 4, wherein a dry wood inlet is provided to a part of the tubular wall plate in the secondary burning chamber, which is located under the air outlet, and a guide tube is provided to the dry wood inlet so as to guide dry wood to be burnt.

* * * * *